US008155581B2

(12) United States Patent
Seder et al.

(10) Patent No.: US 8,155,581 B2
(45) Date of Patent: Apr. 10, 2012

(54) METHOD AND SYSTEM FOR EXHIBITING MEDIA SEGMENTS

(75) Inventors: Thomas A. Seder, Northville, MI (US); Brian S. Repa, Beverly Hills, MI (US); Jodi Forlizzi, Pittsburgh, PA (US); Shelley Evenson, Pittsburgh, PA (US); Joseph F. Szczerba, Grand Blanc, MI (US); John K. Lenneman, Okemos, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 700 days.

(21) Appl. No.: 12/253,950

(22) Filed: Oct. 18, 2008

(65) Prior Publication Data

US 2010/0099350 A1 Apr. 22, 2010

(51) Int. Cl.
*H04H 20/74* (2008.01)

(52) U.S. Cl. ..... 455/3.02

(58) Field of Classification Search ..... None
See application file for complete search history.

(56) References Cited

U.S. PATENT DOCUMENTS

| | | | | |
|---|---|---|---|---|
| 6,952,576 | B2 | 10/2005 | Fish et al. | |
| 2004/0092253 | A1 | 5/2004 | Simonds et al. | |
| 2004/0147241 | A1 | 7/2004 | Engelsberg et al. | |
| 2006/0095396 | A1 | 5/2006 | Ostrover | |
| 2006/0123053 | A1 | 6/2006 | Scannell, Jr. | |
| 2006/0240781 | A1 | 10/2006 | Tabe | |
| 2007/0011321 | A1 * | 1/2007 | Huntington et al. | 709/224 |
| 2007/0011704 | A1 | 1/2007 | Anglin, Jr. | |
| 2007/0067088 | A1 | 3/2007 | Baig | |
| 2007/0150917 | A1 * | 6/2007 | Fernandez | 725/10 |
| 2007/0204285 | A1 * | 8/2007 | Louw | 725/14 |
| 2007/0276783 | A1 * | 11/2007 | Fernandez | 707/1 |

* cited by examiner

*Primary Examiner* — Lincoln Donovan
*Assistant Examiner* — Khareem E Almo

(57) ABSTRACT

A method for exhibiting media segments includes accessing a database including user selection criteria fields associated with media segments and score fields associated with the user selection criteria fields. A directory of media segments is compiled by determining a selection score for each media segment utilizing the score fields. Score fields are modified based on selected media segments, and selected media segments are exhibited.

19 Claims, 2 Drawing Sheets

METHOD AND SYSTEM FOR EXHIBITING MEDIA SEGMENTS

TECHNICAL FIELD

This disclosure is related to methods and systems for selecting and exhibiting media segments.

BACKGROUND

Vehicles include audio devices that allow users to listen to media segments being broadcast via radio frequencies and media segments stored on storage devices such as compact discs, cassette tapes, memory of portable audio players and like devices.

The audio devices are able to tune among numerous radio frequencies, wherein each radio frequency broadcasts a different media segment. Due to the large number of media segments that the audio device can receive, a user is commonly continuously searching for desired media segments that comport with the user's preference. Although preset stations and scanning features may allow a user to find desired media segments more quickly than using a tuning dial, using preset stations and scanning features still include continuously searching for a desired media segment and therefore, still have several drawbacks. For example, using preset stations and scanning features requires the user to search for desired media segments among several media segments. Several of the stations being searched may not be broadcasting a media segment that correlates with the user's tastes. Further, when the user finds a desired media segment, the media segment may be in-progress and therefore, the media segment will not be heard by the user in its entirety.

SUMMARY

A method for exhibiting media segments includes accessing a database including user selection criteria fields associated with media segments and score fields associated with the user selection criteria fields. A directory of media segments is compiled by determining a selection score for each media segment utilizing the score fields. Score fields are modified based on selected media segments, and selected media segments are exhibited.

BRIEF DESCRIPTION OF THE DRAWINGS

One or more embodiments will now be described, by way of example, with reference to the accompanying drawings, in which.

DETAILED DESCRIPTION

Figure 1:
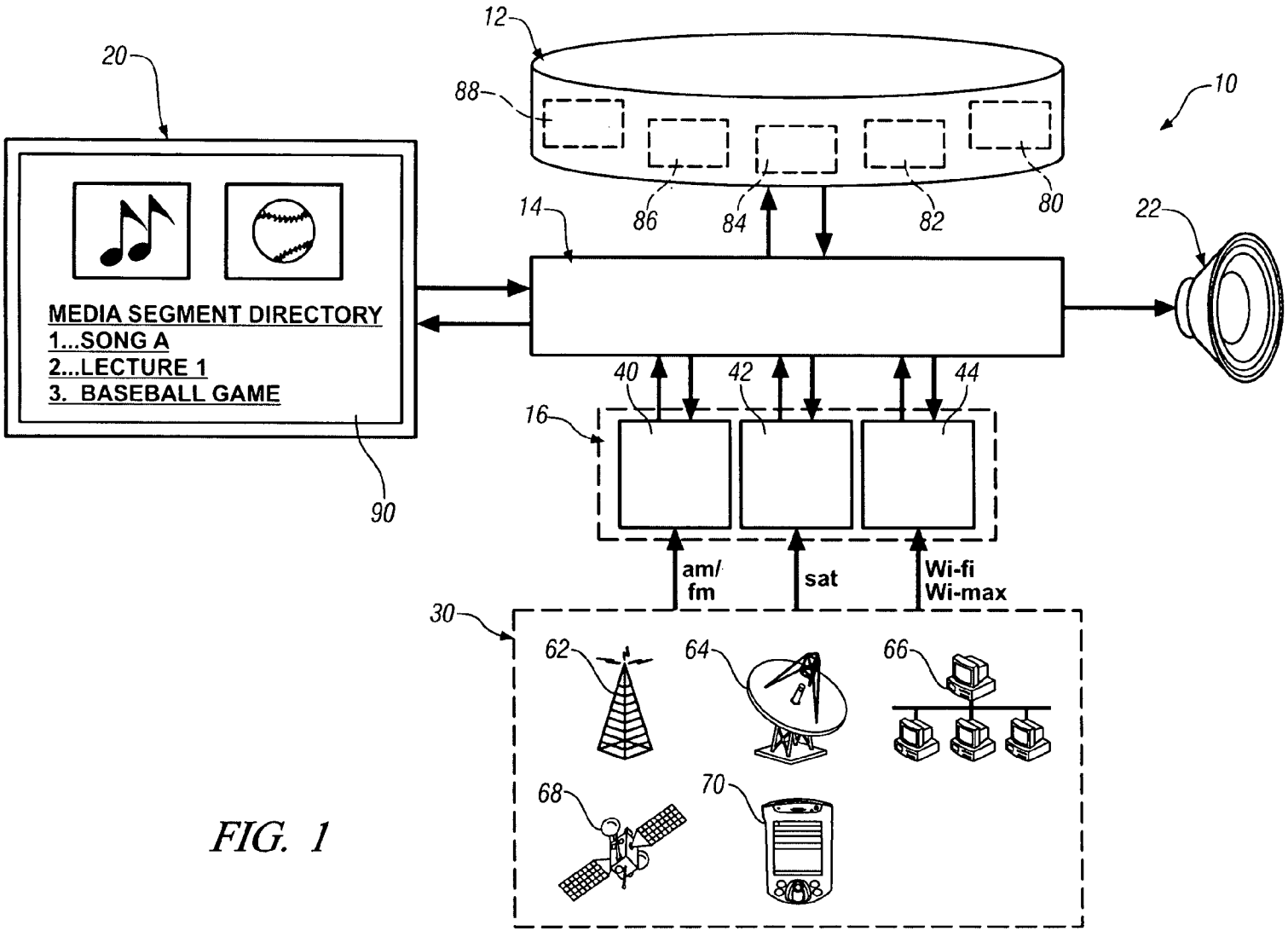
FIG. 1 is a schematic diagram depicting an exemplary system for exhibiting media segments in accordance with an embodiment of the present disclosure.

Referring now to the drawings, wherein the showings are for the purpose of illustrating certain exemplary embodiments only and not for the purpose of limiting the same, FIG. 1 shows a system 10 for exhibiting media segments.

As used herein, the terms "media segment" refers to any exhibited audio or visual information. The terms "media segment data" refers to data that can be manipulated and exhibited as a media segment. The terms "media segment identifier" refers to a title of a media segment or another feature of the media segment that identifies the media segment.

The system 10 includes a storage system 12, a processing system 14, a communications system 16, a user selection interface 20, and a media segment exhibition device 22.

The processing system 14 includes a microprocessor (not shown) configured to utilize processing software 88 stored in the storage system 12 to receive inputs, execute algorithms, synthesize information, and output information. The processing system 14 digitally communicates with the storage system 12, the communications system 16, the user selection interface 20, and the media segment exhibition device 22.

The processing system 14 is configured to access, store, and delete data in a database 86 maintained on the storage system 12. In one embodiment, the processing system 14 accesses, stores, and deletes recorded media segments 84 of the storage system 12. In one embodiment, the processing system 14 manipulates media segment data (for example, by compressing or digitalizing the data) received at the communications system 16 to provide recorded media segments 84 to the storage system 12. In one embodiment, the processing system 14 manipulates media segment data to exhibit the media segment utilizing the media segment exhibition device 22.

The communications system 16 is provided to facilitate transmission and receipt of wireless communication via radio waves between the processing system 14 and external systems 30. The external systems 30 include a terrestrial radio transmitter 62, a satellite radio transmitter 64, a computer network 66, a global positioning system device (hereafter 'GPS') 68, and a personal schedule device 70. The wireless communications system 16 includes a terrestrial radio frequency receiver 40, a satellite radio frequency receiver 42, and a wireless data network interface 44.

The terrestrial radio frequency receiver 40 is configured to receive media segments and associated metadata via radio waves from the terrestrial radio transmitter 62. The terrestrial radio frequency receiver comprises an antenna (not shown) and a tuner (not shown). The antenna is configured to receive radio waves of frequencies set by the tuner and the terrestrial radio frequency receiver 40 processes the radio waves into electric signals and sends the electric signals to the processing system 14. Metadata associated with the media segments can include information such as a title of the media segment and a performer performing the media segment. The terrestrial waves include FM radio waves and AM radio waves. In one embodiment, the terrestrial radio frequency receiver 40 includes multiple tuners such that media segments can be received from multiple radio frequencies simultaneously.

The satellite radio frequency receiver 42 is configured to receive satellite radio waves from the satellite radio transmitter 64, decrypt information received by the satellite radio waves, and to convert the information received by the satellite radio waves to signals that can be processed by the processing system 14. Information received by the satellite radio waves includes media segments and associated metadata. In one embodiment, the satellite radio frequency receiver 42 sends encrypted radio signals (for example, when receiving media segments from subscription services) to the processing system 14 and the processing system 14 decrypts the radio signals.

In alternate embodiments, media segments and metadata can be received via other types of wireless communications. Exemplary types of wireless communications include TV band communications (for example, UHF and VHF band communications,) wireless peer-to-peer communications accessing the Internet (for example, Wi-Fi and Wi-Max communications,) and cellular communications.

The data network interface 44 is provided to facilitate transmission and receipt of wireless communication via radio frequencies between the processing system 14 and data networks such as an external computer network 66, the GPS device 68, or the personal scheduling device 70. In one embodiment, the wireless data network interface 44 accesses the computer network 66, the GPS device 68 and the personal scheduling device 70 utilizing wireless peer-to-peer communications such as for example, Wi-Fi and Wi-Max communications.

The computer network 66 provides information including a media segment guide 80 and information utilized to update fields of the database 86. The guide 80 includes a plurality of media segment identifiers along with availability information associated with each media segment. In one embodiment, the guide 80 provides information including a plurality of media segment identifiers, an available time associated with each media segment (for example, the time at which the media segment is broadcast), and access information associated with each media segment identifier (for example, the radio station that the media segment will be broadcast on.) In one embodiment, the media segment guide 80 is updated within the storage system 12, periodically. In one embodiment, the media segment guide 80 is downloaded from the Internet. In an alternative embodiment, the guide is stored externally, for example, a system for exhibiting media segments accesses the guide from the Internet, but the system for exhibiting media segments does not store the guide.

The GPS device 68 provides information relating to a global position. In one embodiment, the GPS device 68 provides GPS coordinates indicative of a current global position of the system 10. In one embodiment, the GPS device 68 communicates to the system 10 through the communications system 16. In one embodiment, the GPS device 68 communicates with the system 10 using communication wires.

The storage system 12 comprises a storage device (not shown) storing digitally encoded data. Exemplary storage devices for the storage system 12 include flash memory storage devices, magnetic hard drive storage devices, solid state storage devices, and like data storage devices. In one embodiment, the storage system 12 comprises a single storage device accessible by the processing system 14. In one embodiment, the storage system 12 comprises multiple storage devices, wherein each storage device is accessible by the processing system 14.

The data stored by the storage system 12 includes data associated with the guide 80, data associated with a directory 82, data associated with recorded media segments 84, data associated with a database 86, and data associated with processing software 88.

The directory 82 includes media segment identifiers that identify media segments available for exhibition. In one embodiment, the media segment available for exhibition includes recorded media segments 84, and media segments data that are available to be received from the external systems 30 via the communications system 16. In one embodiment, the media segment identifiers of the directory 82 are associated with user selection preferences. In one embodiment, the media segment identifiers of the directory 82, are associated with media segments having high user selection scores.

The recorded media segments 84 include data that are processed by the processing system 14 for exhibition by the media segment exhibition device 22. In one embodiment, the recorded media segments 84 are stored in a compressed media storage format that can be decompressed by the processing system utilizing the processing software 88.

The database 86 includes both a storage structure and several records that are stored, accessible, and updateable within the storage structure to define a user selection criteria database. Each record includes a user selection criteria field and a score field associated with the user selection criteria field.

The user selection criteria field includes criteria descriptive of a particular media segment. By means of non-limiting examples, the user selection criteria field can include criteria descriptive of a particular media segment including "talk", "music", "news", "world news", "local news", "world weather", "local weather", "national weather", "national sports", "local sports", "regional information", "football news", "soccer news", "short story reading", "science", "plasma physics", "Performer A", "Rock Band Y", "soul music", "country music", "surf music", "fast beat music", "melancholy beat music", "Christmas music," and "song title A." As used herein above, the term "local" is used to designate types of media segments associated with a particular geographic region. However, it is to be understood that "local" as in local weather also has the specific region associated therewith such as "State A" weather or "City X" weather.

The exemplary listing of user selection criteria fields exemplifies that the user selection criteria fields can cover a large number of media segments or a small number of media segments. Further, this listing exemplifies that a single media segment can have, greater than ten or greater than one hundred user selection criteria fields associated therewith, and the database can contain, for example, over one thousand user selection criteria fields.

The score field includes values and algorithms that are associated with the user selection criteria field. In one embodiment, the algorithms include complex algorithms wherein the algorithm has variables associated with several user selection criteria fields, wherein each field is given a different level of weight when associating the selection criteria with the media segments.

The score field is updateable. In one embodiment, the score field is updated based on a user selection from the directory. In one embodiment, the score field is updated based on external modification values received by the system 10 from the external systems 30. In one embodiment, the external modification values are based on collaborative data based on other users having similar tastes in music. The collaborative data can be stored on a database of the computer network 66. The collaborative data can include selection data from multiple users and can be analyzed to predicted future preferences of any one of the users based upon past selections of the multiples users. The collaborative data allows the system to score media segments based on information regarding the interests of several people. The system 10 can access the collaborative data via the computer network 66. In one embodiment, the score field is updateable by accessing transactional information, for example information relating to items purchased by the user, items purchased by other people having a similar taste to the user, and items recommended by other people. In one embodiment, the external modification values are based on information included in the personal scheduling device 70.

The external modification values can include modification values based on an external event. External events include temporal events and location-based events. Temporal events include events associated with a time period including a time of day, a day of the week, a month, etc. Temporal events further includes temporal proximity to a set event, for example, temporal proximity to holidays (e.g. Christmas) or temporal proximity to a sporting event. The score field can be modified after the occurrence of the set event, such that the set event no longer affects values of the score field. The location-based event includes events associated with a proximity of the system 10 to a selected location. In one embodiment, the location-based event is associated with a proximity the GPS coordinates transmitted by the GPS device 68. For example, the user-selection criteria associated with a media segment database can include a modification function to modify the score field associated with the user selection field "City A weather" based on the system's 10 proximity to City A or the score field associated with "surf music" based on the system's 10 proximity to an ocean. The score field can be modified after the system 10 is no longer proximate to the set of GPS coordinates, such that the set of GPS coordinates no longer modifies the values of the score field.

Each score field can have different values associated with different users. For example, the score field can include a first set of values and algorithms associated with each selection criteria and associated with a first user and the score field can include a second set of values and algorithms associated with each selection criteria field and associated with a second user. Each media segment is also associated with the user selection criteria fields. Therefore, the database 86 can access the score fields associated with each user selection criteria field associated with each media segment to determine a selection score for each media segment.

The database 86 is configurable to be updated by the processing system 14. For example, the media selection selection criteria fields can be added or deleted. Further, the score fields can be modified based on user selections or based on external events detected by the processing system 14.

The processing software 88 includes software that processing system 14 utilizes to receive inputs, execute algorithms, synthesize information, and output information as described herein. The processing software further includes software that allows the processing system to send information to and receive information from the user selection interface 20, and send information to the media segment exhibition device 22. The processing software 88 further includes software that the processing system 14 utilizes to exhibit the media through the media segment exhibition device 22.

The user selection interface 20 provides the directory 82 to the user and allows the user to select a media segment from the directory 82. In one embodiment, the user selection interface 20 comprises a touch screen display 90. The touch screen display includes an LCD display and sensors (not shown) disposed around the LCD display to indicate a location at which the LCD display is contacted by the user. The LCD display 91 can display graphical icons or text indicating media segments of the directory 82 and the user can contact the icon or text of the touch screen display to select the available media segment for exhibition. The user can to add, score, modify delete, or make playlists, of the recorded media segments 84 using the user selection interface 20.

The media segment exhibition device 22 is provided to exhibit the media segments to the user. In one embodiment, the media segment exhibition device 22 includes a speaker and an amplifier (not shown). In an alternative exemplary embodiment, the media segment exhibition devices includes a display screen (not shown) to display video media segment along with or instead of the audio media segments.

Figure 2:
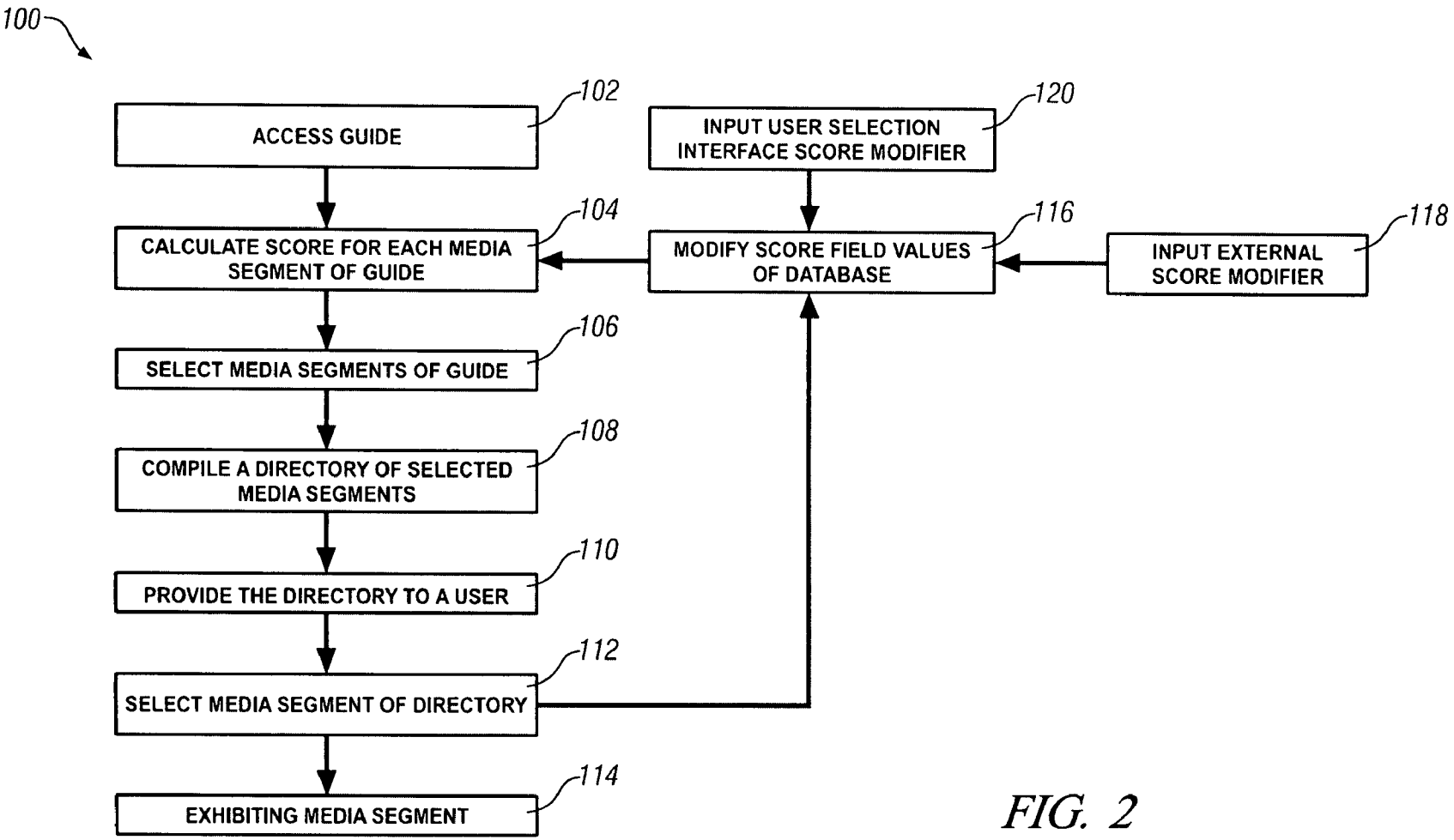
FIG. 2 is a process flow chart depicting an exemplary method for exhibiting media segment in accordance with an embodiment of the present disclosure.

Referring to FIG. 2, a method 100 for exhibiting media segments is shown. The processing system 14 accesses the guide 80 (102). In one embodiment, the processing system accesses the guide by processing media segment identifiers and user selection criteria associated with the media segment identifiers. In one embodiment, the processing system 14 accesses the guide 80 from the storage system 12. In one embodiment, the processing system 14 downloads the guide 80 to the storage system 12 periodically from the computer network 66. In one embodiment, the processing system 14 accesses a guide directly from the computer network 66 without downloading the guide 80 to the storage system 12.

The processing system 14 calculates a selection score for each media segment identifier of the guide 80 (104). The processing system 14 calculates the selection score by associating a plurality of user selection criteria fields of the database with each media segment identifier of the guide 80, wherein each user selection criteria field is associated with a score field of the database 86. The processing system 14 utilizes the score fields to determine an overall selection score of the media segment identifier.

In an alternate embodiment, the system 10 continuously searches radio frequencies bands utilizing the terrestrial radio frequency receiver 40 and satellite frequency bands utilizing the satellite radio frequency receiver to capture metadata including media segment identifiers associated with media segment broadcasts. The processing system 14 calculates the selection score by associating a plurality of user selection criteria fields of the database 86 the captured media segment identifiers.

The processing system 14 selects media segment listings of the guide 80 (106). In one embodiment, the processing system 14 selects media segment listings having a calculated selection score above a threshold selection score. In one embodiment, the threshold score is based on a user selected search tolerance level, wherein the user can adjust the user selected search tolerance score based on a desired size of a media segment directory for the user to choose media segment listings from.

The processing system 14 compiles a directory of selected media segments (108). In one embodiment, the processing system 14 compiles the directory of media segments by receiving media segments selected in step 106 through the communications system 16, and buffering the media segments in the storage system 12. The processing system 14 creates a directory comprising media segment identifiers of the selected media segments. In one embodiment, only a portion of the media segment is buffered such that the user is provided an opportunity to select the media segment and the media segment can be exhibited in its entirety. For example, in one embodiment, one minute of the media segment can be buffered at a given time, such that the user can select the media segment up to one minute after the start of the media segment broadcast for the media segment to be exhibited in its entirety. The processing system 14 can delete the buffered portion of the media segment if the media segment is not selected. In an alternate embodiment, the entire media segment can be buffered. Further in an alternate embodiment, the processing system 14 compiles a directory of selected media segments by creating a directory comprising media segment identifiers without buffering the media segments such that the media segments of the directory are accessible directly by the processing system 14 through the communications system 16.

The processing system 14 provides the directory 82 to a user (110). In one embodiment, the processing system 14 provides the directory 82 to the user by providing the directory 82 to user selection interface 20. In one embodiment, the processing system 14 provides the directory 82 to the user selection interface 20 by providing the directory 82 to the touch screen display 90 of the user selection interface by, for example, providing text, graphical icons, and combinations thereof which are descriptive of the media segments to the touch screen display 90.

The user selects a media segment from the directory 82 (112). In one embodiment, the user selects the media segment by providing an input to the user selection interface 20. The input is received by the user selection interface and routed from the user selection interface 20 to the processing system 14. In one embodiment, the media segment is selected by selecting a graphic icon or text from the touch screen display 90. In one embodiment, the user selects the media segment by issuing a voice command which is received by a microphone (not shown) of the user selection interface 20 which is routed to the processing system 14 wherein the processing system 14 utilizes voice recognition software within the processing software 88 to translate the voice command into an input to select the media segment from the directory 82.

In one embodiment, the user can choose to filter the directory 82 prior to selecting the media segment. For example, the directory 82 can be provided in a menu format having specific categories (for example, talk, music, or categories relating to genres of music). The user can first select a category from the menu and then select the media segment listing of the directory 82 within the selected category.

The processing system 14 routes media segment data to the media segment exhibition device 22, and the media segment exhibition device 22 exhibits the media segment (114). In one embodiment, the processor accesses the recorded media segment 82 from the storage system 12 and processes the data of the recorded media segment 82 to output the data to the media segment exhibition device 22. In one embodiment, the media segment is routed from the communications system 16 through the processing system 14 to the media segment exhibition device 22 without storing the media segment in the storage system 12. In one embodiment, the processing system synthesizes media segment data prior to providing the media segment to the media segment exhibition device 22. In one embodiment, the processing system 14 synthesizes media segment data by decoding, decrypting, or decompressing the media segment data prior to providing the media segment to the media segment exhibition device 22. In one embodiment, the media segment exhibition device 22 exhibits the media by generating sound waves. In one embodiment, the media segment exhibition device exhibits the media segment by visually displaying the media segment on a display screen of the media segment exhibition device. In one embodiment, processing system 14 calculates a selection score for a media segment over an immediate play threshold score, and exhibits the media segment to the media segment exhibition device without the user selecting the media segment.

The processing system 14 modifies the score fields of the user selection database (116). In one embodiment, the processing system 14 modifies the score fields of the user selection database based on the user selection of step 112. In one embodiment, the processing system 14 modifies the score fields of the user selection database associated with user selection criteria field associated with the selected media segment. In one embodiment, the processing system 14 modifies the score fields such that media segments associated with the user selection criteria field of the selected media segment will be scored higher in the future. In one embodiment, the processing system 14 modifies score fields associated with media segments that are compiled in the directory of selected media segment 108, but are not selected by the user 112. In one embodiment, the processing system 14 modifies the score fields of the user selection database based on the selected media segment such that the score fields associated with the media segments that are not selected will be have lower calculated scores in the future.

In one embodiment, the processing system 14 modifies score fields of the database based on external modification values (118). In one embodiment, the external modification values are received from the computer network 66. The processing system 14 modifies score fields of the database based on a user input values (120). The user input values are based on manual user inputs. The manual user input can include inputs through the user selection interface 20 or utilizing a computer (not shown) interfacing with the computer network 66.

The disclosure has described certain preferred embodiments and modifications thereto. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. A method for exhibiting media segments comprising:

receiving media segment identifiers identifying media segments available for exhibition comprising recorded media segments data and broadcast media segments data available to be received from external systems;

accessing a database including user selection criteria fields associated with the media segment identifiers and score fields associated with the user selection criteria fields;

compiling a directory of media segment listings by determining a selection score for each media segment identifier utilizing the score fields;

selecting media segments based on a user selection from the directory of media segment listings;

modifying the score fields based on the selected media segments; and exhibiting the selected media segments.

2. The method of claim 1, further comprising receiving selected media segments via one of a satellite radio band signal, a terrestrial radio band signal and a wireless internet signal.

3. A method for exhibiting media segments comprising:

accessing a database including user selection criteria fields associated with media segments and score fields associated with the user selection criteria fields;

compiling a directory of media segments by determining a selection score for each media segment utilizing the score fields;

modifying the score fields based on selected media segments;

exhibiting selected media segments;

identifying one of a first user and a second user;

determining selection scores for each media segment utilizing a first set of score fields when the first user is identified; and determining selection scores for each media segment utilizing a second set of score fields when the second user is identified.

4. The method of claim 1, wherein determining the selection score for each media segment identifier comprises determining the selection score based on a temporal event.

5. The method of claim 1, wherein determining the selection score for each media segment identifier comprises determining the selection score based on GPS coordinates.

6. The method of claim 1, wherein compiling a directory of media segment listings further comprises:

accessing a media segment guide; and compiling the directory of media segment listings by selecting media segment listings of the media segment guide.

7. The method of claim 6, further comprising:

calculating selection scores for media segment listings of the media segment guide utilizing the score fields.

8. The method of claim 1, further comprising providing the directory of media segment listings to a user via a touch screen display.

9. The method of claim 1 further comprising:

determining a user selection input; and selecting a media segment from the directory based upon the user selection input.

10. The method of claim 9, further comprising selecting a media segment based on an input signal from a touch screen display.

11. The method of claim 1, wherein compiling the directory of media segment listings further comprises downloading media segments of the directory of media segment listings to a storage system.

12. A method for exhibiting media segments comprising:

receiving media segment identifiers identifying media segments available for exhibition comprising recorded media segments data and broadcast media segments data available to be received from external systems;

accessing a database to determine user selection criteria fields associated with the media segment identifiers of a media segment guide and score fields associated with the user selection criteria fields;

calculating a user selection score for each media segment identifier of the media segment guide based on the score field associated with the user selection criteria fields;

selecting media segments having a user selection score greater than a threshold score;

compiling a directory of the selected media segments; and providing the selected media listings to a user.

13. The method of claim 12, further comprising downloading the media segment guide to a storage media.

14. The method of claim 12, further comprising accessing the guide media segment guide from an external computer network using wireless communication signals.

15. A system for exhibiting media segments comprising a storage system, a processing system, a user selection interface, and a media segment exhibition device;

said storage system comprising data associated with a directory of media segment listings, data associated with recorded media segments, data associated with a user selection criteria database, and data associated with processing software;

a communications system digitally communicating with the processing system, said communications system configured to receive broadcast media segments via radio waves;

said processing system being in digital communication with the storage system and the communications system and configured to receive media segment identifiers identifying media segments available for exhibition comprising the recorded media segments and the broadcast media segments;

access the user selection criteria database including user selection criteria fields associated with the media segment identifiers and score fields associated with the user selection criteria fields;

compile the directory of media segment listings by determining a selection score for each media segment identifier utilizing the score fields;

utilize data associated with the processing software of the storage system to select a media segment from the directory of media segment listings, modify the user selection criteria database based on the selected media segment, and send data for exhibiting the selected media segment to the media segment exhibition device;

said user selection interface being in digital communication with the processing system and configured to provide information associated with available media segments to a user, and input a user selected media segment; and said media segment exhibition device being in digital communication with the processing system and configured to receive data for exhibiting the selected media segment from the processing system, and exhibit the user selected media segment.

16. The system of claim 15, wherein the communications system is further configured to receive data associated with a media guide from a computer network.

17. The system of claim 15, wherein the communications system is further configured to receive data from a GPS device, and wherein the processing system is configured to utilize the information from the GPS device to modifying the user selection criteria database.

18. A system for exhibiting media segments comprising a storage system, a processing system, a user selection interface, a media segment exhibition device and a communications system digitally communicating with the processing system;

said storage system comprising data associated with a directory of media segments, data associated with recorded media segments, data associated with a user selection criteria database, and data associated with processing software;

said communications system configured to receive broadcast media segments via radio waves;

said processing system being in digital communication with the storage system and configured to utilize data associated with the processing software of the storage system to select a media segment from the directory of media segments, modify the user selection criteria database based on the selected media segment, and send data for exhibiting the selected media segment to the media segment exhibition device;

said user selection interface being in digital communication with the processing system and configured to provide information associated with available media segments to a user, and input a user selected media segment;

said media segment exhibition device being in digital communication with the processing system and configured to receive data for exhibiting the selected media segment from the processing system, and exhibit the user selected media segment; and said communications system configured to receive media segments via radio waves;

wherein the communications system comprises at least two radio frequency tuners.

19. The system of claim 15, wherein the user selection interface is a touch screen display.

* * * * *